US007036178B1

(12) United States Patent
Sigrist

(10) Patent No.: US 7,036,178 B1
(45) Date of Patent: May 2, 2006

(54) SHOES CLEANING MACHINE

(75) Inventor: Richard Sigrist, Rickenbach (CH)

(73) Assignee: Nitty Gritty S.R.L., Formigine (IT)

( * ) Notice: Subject to any disclaimer, the term of this patent is extended or adjusted under 35 U.S.C. 154(b) by 466 days.

(21) Appl. No.: 10/110,069

(22) PCT Filed: Oct. 5, 2000

(86) PCT No.: PCT/IB00/01432

§ 371 (c)(1),
(2), (4) Date: Sep. 17, 2002

(87) PCT Pub. No.: WO01/24680

PCT Pub. Date: Apr. 12, 2001

(30) Foreign Application Priority Data

Oct. 7, 1999 (IT) ..... MO99A0210

(51) Int. Cl.
*A47L 23/22* (2006.01)

(52) U.S. Cl. ..... 15/34; 15/21.1; 15/30; 15/36; 15/97.2; 15/161

(58) Field of Classification Search ..... 15/161, 15/112, 36, 30, 237, 32, 33, 34, 35, 21.1, 15/97.2, 311, 302, 303, 179
See application file for complete search history.

(56) References Cited

U.S. PATENT DOCUMENTS 4,435,964 A 3/1984 Nobuo
5,486,970 A * 1/1996 Lee et al. ..... 360/128

FOREIGN PATENT DOCUMENTS

| | | |
|---|---|---|
| FR | 2 688 397 A | 9/1993 |
| FR | 2 785 168 A | 5/2000 |
| WO | 9304624 A | 3/1993 |

* cited by examiner

*Primary Examiner*—Richard Crispino
*Assistant Examiner*—Abraham Bahta
(74) *Attorney, Agent, or Firm*—Millen, White, Zelano & Branigan, P.C.

(57) ABSTRACT

A shoe cleaning machine is provided with one group of brushes (11) comprising at least one brush (11) with bristles aligned in a certain direction (11*a*) and at least a second brush (11*b*) with bristles aligned perpendicular to those of the preceding brush. A pan (13) for collecting dirt is positioned under the group of brushes and at least one nozzle (11*c*) sprays water on the group. An operator arm (8) carries at least one last (4) to which a shoe to be cleaned is tied: the arm has a linear actuator (9) with certain positions of extension, and is also intermediate to, a rotary actuator (10) which rotates the arm with respect to the frame (1) of the machine, to move the said lasts from the loading station (3) to the group of brushes and on to the discharge (16). In a second embodiment the machine presents a washing and/or drying station (41) that includes at least one mobile nozzle (42), made to cover the external surface of the shoe, which is rotatable by a rotary actuator (33) on the center line of the last (4).

24 Claims, 10 Drawing Sheets

SHOES CLEANING MACHINE

The invention concerns: a machine for cleaning shoes, that is, a machine suitable for cleaning mud and dirt from shoes, in particular sports shoes, also drying and distributing protective substances, automatically with individual shoes, pairs or groups of shoes.

BACKGROUND OF THE INVENTION

The state of the art does not comprise machines dedicated to cleaning shoes, particularly sports shoes: athletes have to perform the cleaning and care of their shoes by hand.

There are, however, machines for cleaning work shoes of workers in the food industry, where the worker transits trough a set location wearing the shoes or boots, where a series of brushes and jets of water clean the soles and the upper part of the shoes or boots. There are, finally, also machines for polishing shoes, typically used by shoe polishers, having brushes, with vertical axis, that rotate around the shoe worn by the user, which apply the polish and subsequently perform the final polishing.

Finally, in the sports environment, the task of cleaning the shoes is a long and laborious one, especially in sports played in grassy fields, and, whilst the better paid athletes can afford to delegate the said task to the appropriate personnel, amateur or hobby athletes have to perform the task in the changing rooms after the game or sporting event, or later at home. In this case the mud and dirt often dries out on the shoes, making the subsequent task of cleaning the shoes longer and more difficult.

Such state of the art may be subject to considerable improvement regarding the possibility to free the user to have shoes on during the cleaning and to make more fast and reliable the cleaning of the shoes especially sports shoes.

From what has been said so far, the necessity arises of resolving the technical problem of finding a machine configured in such a way as to enable the shoe, or one or more pairs of shoes to be gripped, which removes the dirt also by means of washing, and applies the final protective care.

BRIEF SUMMARY OF THE INVENTION

The invention resolves the said technical problem by adopting: a machine for cleaning shoes, comprising at least one group of brushes, for cleaning the soles and uppers, characterised in that the said group consists of at least one brush with the bristles aligned in a certain direction, at least one second brush with the bristles aligned in a direction perpendicular to the bristles of the previous brush; a pan for collecting the dirt positioned under the said group of brushes; at least one nozzle for spraying water on the said group; an operator arm carrying at least one last, to which a shoe to be cleaned is tied: the said arm consisting of a linear actuator having fixed positions of extension, even intermediate, and a rotary actuator to rotate the said arm with respect to the frame of the machine, to move the said lasts from the loading station to the group of brushes and to the discharge.

Adopting, in a preferred embodiment: the said group of brushes consisting of a single brush with radial bristles and axial bristles assembled to and rotating on the same axis.

Adopting, in another and preferred embodiment: the said brushes, advantageously, subdivided in two groups with respective axes of rotation perpendicular to each other and positioned in proximity to the said collecting pan.

Adopting, in a preferred embodiment: the shoes positioned on a pair of lasts side by side, so conformed as to be progressively positioned simultaneously by corresponding pairs of the said group or groups of brushes.

Adopting, in a preferred embodiment: beneath the said pan there being a shredding device for the discharge of the mud and dirt directly to the sewer.

Adopting, in a preferred embodiment: a further set of brushes for drying, oiling and polishing of the shoes.

Adopting, in a preferred embodiment: the further set of brushes consisting of a single brush with radial bristles and axial bristles assembled to and rotating on the same axis.

Adopting, in a preferred embodiment: a storing area associated with it, having a conveyor on which a number of shoes already placed on their respective lasts can be placed; the feed to the storing room is handled directly by the cleaning machine; each last or pair of lasts has at least one bayonet coupling to attach it to the operator arm.

Adopting, in a preferred embodiment: the said bayonet coupling having an electrical connection and/or one or more connectors for pressurised fluids.

Adopting, in a preferred embodiment: each last having a manual device for winding the shoe laces, consisting of a pin or spindle onto which the laces are wound and of a device for detecting the fixing of the extremities of the laces; the said mechanism possibly having an electrical sensor for detecting whether the extremities of the laces are fixed or not.

Adopting, in a preferred embodiment: each last having a motorised pin or spindle to wind the laces of the respective shoe; the said electrical motor possibly having an output torque control.

Adopting, in a preferred embodiment: each last having an actuator cylinder to advance the extremity of the said last.

Adopting, finally, in a preferred embodiment: each last being encased with an inflatable elastic sock, shaped to grip the shoe from inside and/or as a seal against the entry of water.

The advantages achieved with this invention are: at the end of the cleaning cycle the user receives his pair of shoes which have been completely cleaned from mud and dirt and protected with suitable substances without labouring and being able, during the operation of the machine to dedicate himself to other matters; the cleaning of the sole occurs entirely by the action of the two groups of brushes dedicated to this purpose, with horizontal and vertical axes, in order to reach all the areas of soles with spikes; the dirt collected is treated by the shredder inside the machine and discharged into the sewer without blocking it; the shoes to be cleaned are housed in a conveyor which brings them as required to the loading point of the shoe cleaning machine, thereby making it unnecessary for the user to wait by the machine during the cleaning cycle of his or other athletes' shoes; the last with extendible cylinder enables a certain range of numbers of shoes to be fixed, as opposed to the single number of the fixed form; the inflatable sock ensures perfect sealing during the washing phase, and when used on its own, also enables a certain range of numbers to be fixed; the initial manual or driven winding of the laces of the shoes prevents damaging the brushes of the machine and/or the shoes themselves.

Finally, in the embodiment with the washing and/or drying station, the shoe to be cleaned are turned by the rotary actuator to expose the entire surface to the nozzle to enable, together with the motion of the nozzle on its guides, the complete coverage of the shoe during washing and/or drying.

BRIEF DESCRIPTION OF THE SEVERAL VIEWS OF THE DRAWINGS

Some embodiments of the invention are illustrated, purely by way of example, in the ten tables of drawings attached, in which.

DETALIED DESCRIPTION OF THE INVENTION

Figure 1:
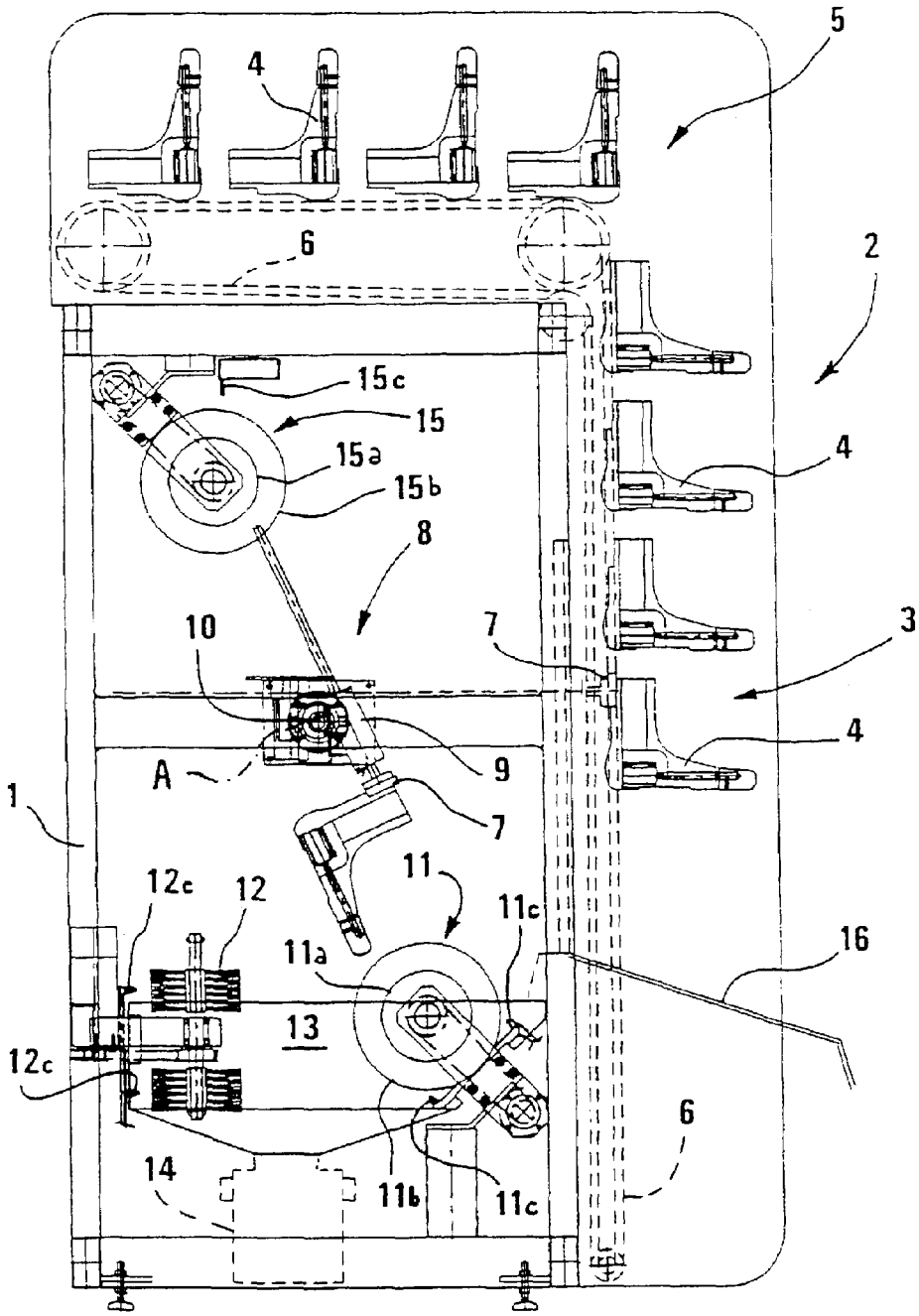
FIG. 1 is a schematic sectional view along a vertical longitudinal plane of the shoe cleaning machine as described.
Figure 2:
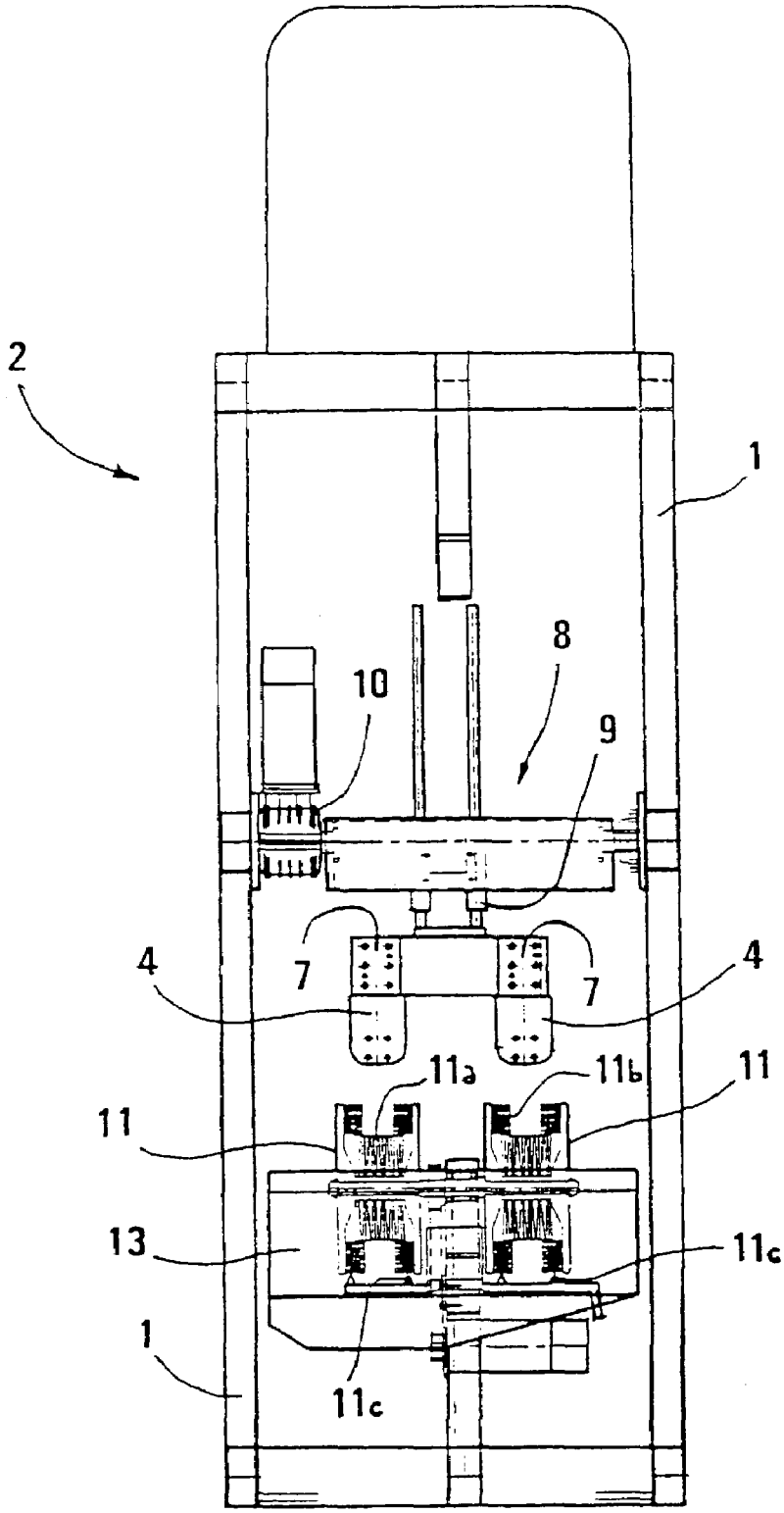
FIG. 2 is a schematic section in vertical transverse plane of the machine in preceding Figure.

The Figures show: a frame 1 of the shoe cleaning machine 2, at the front of which there is, as well as the loading station 3 of the lasts 4, a storage area 5 capable holding up to eight pairs of shoes already positioned on the respective lasts 4; the said storage area consists of a belt or chain conveyor 6 which carries the lasts, mobile in the front and/or top side of the machine 2; a bayonet coupling 7 of known type to connect the pair of lasts holding a pair of shoes to the operator arm 8 of the machine; an actuator 9 with linear motion which has intermediate positions, at whose front extremity there is the said bayonet coupling: it is made to rotate on a horizontal axis A by means of a motor 10 fixed to the said frame 1; a group of lower brushes 11 made to rotate on a horizontal axis in the lower part of the machine 2, consisting of a pair of brushes positioned side by side axially, each having radial bristles 11*a* and axial bristles 11*b*; nozzles 11*c* that spray water on the said brushes; a group of brushes 12 with vertical axis positioned, advantageously, at an analogous height to the preceding brushes 11; nozzles 12*c* that spray water on the said brushes; a pan 13 for collecting the water used and the mud and a shredder 14 to break up and discharge the said mud into the sewer; a group of upper brushes 15 with horizontal axis of rotation for drying, oiling and polishing, consisting of a pair of brushes positioned side by side axially, each having radial bristles 15*a* and axial bristles 15*b*; a distributor 15*c* of protective substances onto the said brushes; a discharge chute 16 for the clean shoes, still mounted on the respective lasts 4.

Figure 7:
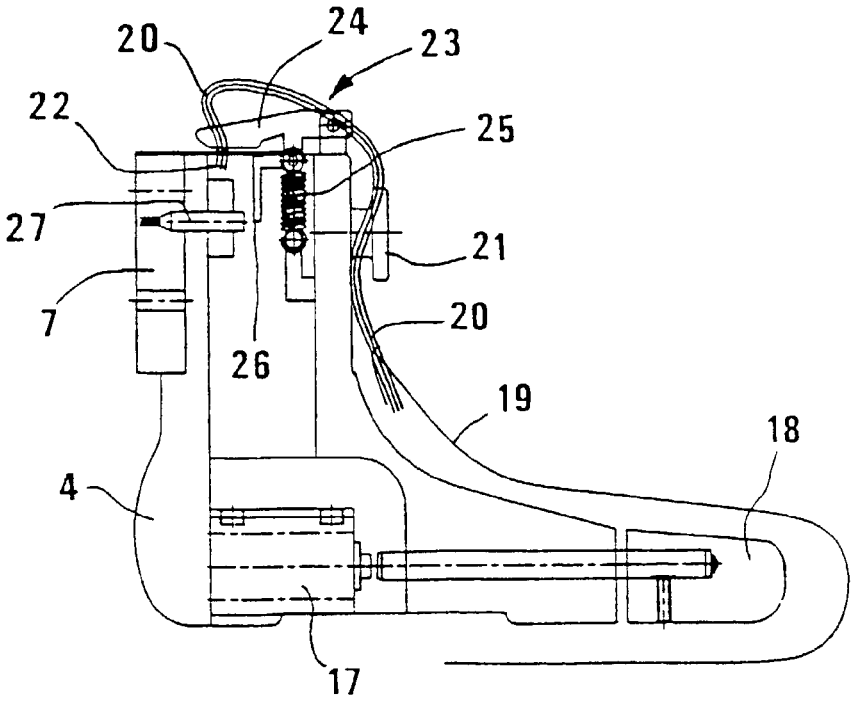
FIG. 7 is a schematic partial longitudinal section of an extendible last, moreover equipped with a manual device for winding the laces.
Figure 8:
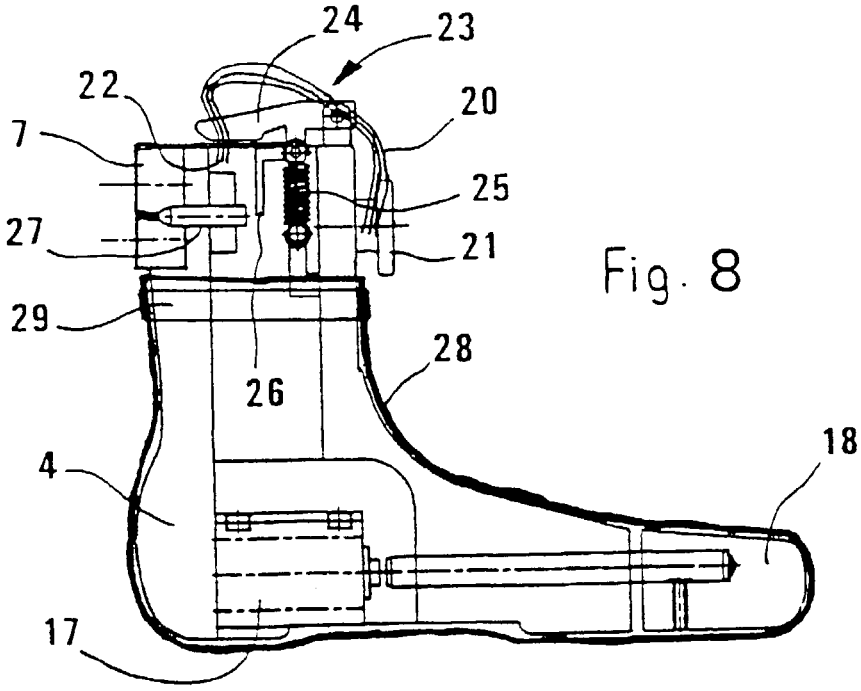
FIG. 8 is a partial schematic longitudinal sectional view of the last in the preceding Figure, also equipped with sock expandable under pressure.
Figure 9:
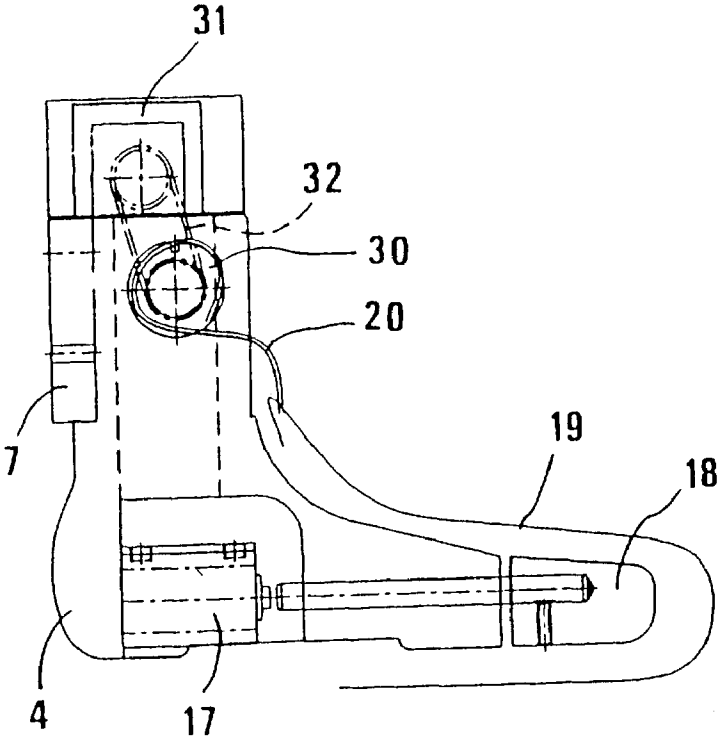
FIG. 9 is a partial schematic longitudinal sectional view of the last in FIG. 7, equipped with a driven device for winding the laces.
Figure 10:
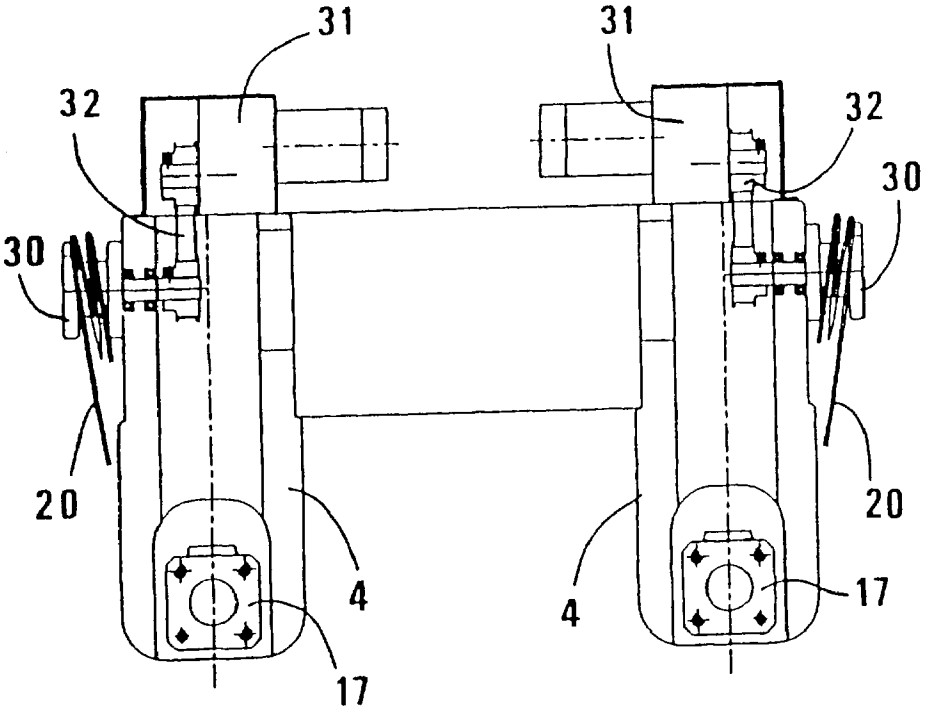
FIG. 10 is a transverse partially sectioned schematic view of the group of lasts in the preceding Figure.

FIG. 7 also shows an actuator cylinder 17 to advance the extremity 18 of the last to ensure the secure fixing of the shoe 19, here shown only partially; laces 20 of the shoe, wound manually on the spindle 21, whose extremities are positioned consensus and safety mechanism 23: the said mechanism consists of a pad 24 to which the elastic force of the spring 25 is applied and a protuberance of the pad is positioned close by a proximity sensor 27 for the consensus to initiate the cycle of the machine; FIG. 8 shows a sock 28 made of elastic material with areas of predetermined deformation, inflatable with the influx of fluid to fill the shoe and to prevent the entry of water; a band 29 to fix the said sock onto the body of the last 4; FIG. 9 shows a rotary spindle 30 driven by the motor 31, with torque control, by means of transmission 32, to wind the said laces 20 of the shoe to be cleaned.

Figure 11:
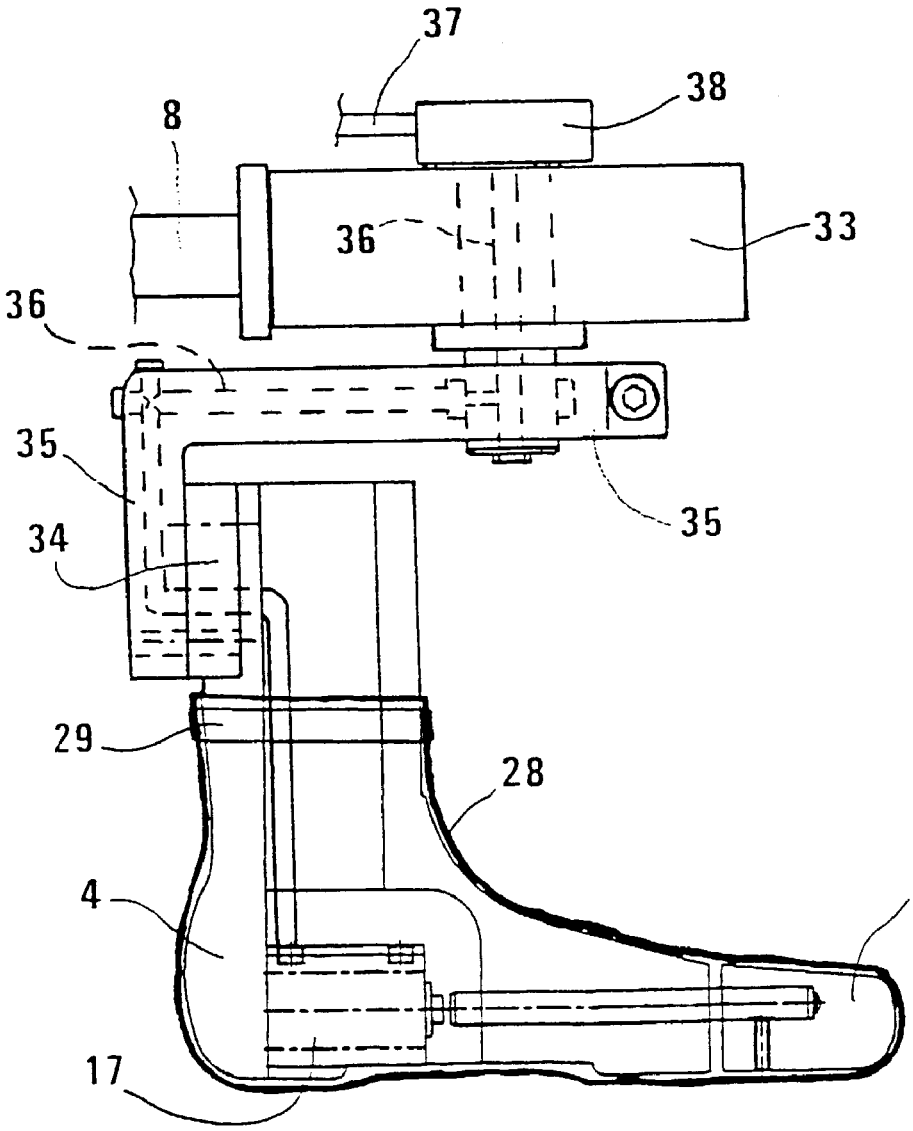
FIG. 11 is a longitudinal partially sectioned schematic view of the last in FIG. 8, equipped with an actuator device for rotating the shoe between the said last and the operator arm.
Figure 12:
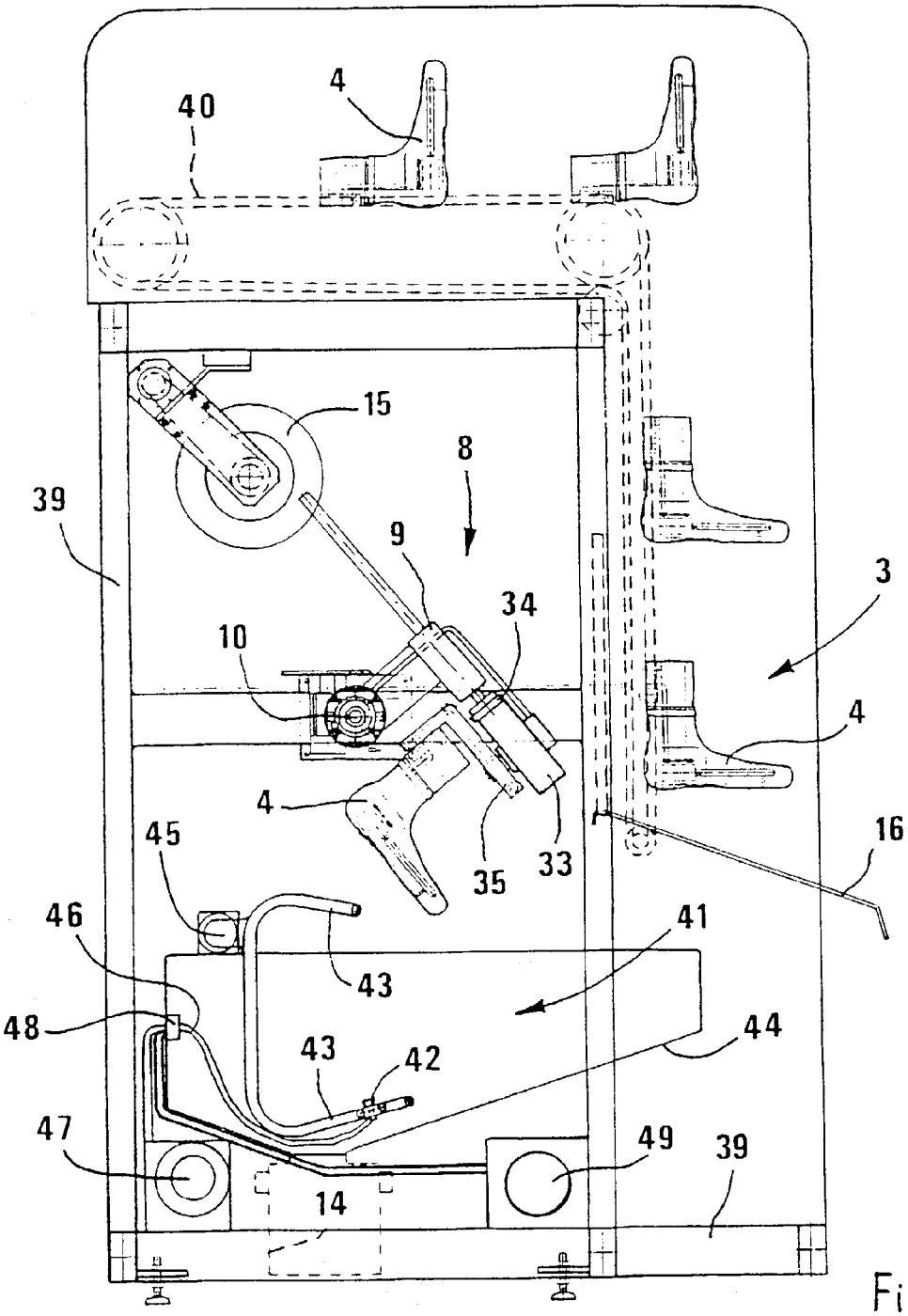
FIG. 12 is a schematic sectional view in a vertical longitudinal plane of the shoe cleaning machine as described in a second form of embodiment with a cleaning and/or drying station.

Finally, FIG. 11 also shows: a rotary actuator 33 placed between the arm 8 and the last 4, to enable the rotation of the shoe in the washing station; a bayonet coupling 34, similar to the coupling 7, made to connect with the rotating support 35, having, internally, conduits 36 to supply the cylinder 17 and/or the sock 28; a feed tube 37 and a rotary distributor 38 of the fluid to the conduit 36; FIG. 12, shows a metallic structure 39 of the shoe cleaning machine equipped with chain conveyor 40 onto which the lasts 4 are supported, that constitute the storage area of the machine; a washing and/or drying station 41 having nozzles 42 mobile along guides with a curved trajectory 43: the said station is positioned inside a pan 44 for collecting water and mud under which is installed the shredder 14; a motor 45 controlling the said mobile nozzles 42, each supplied by means of coaxial flexible tubes 46 with air and water from a pump 47 for the water and by a blower or compressor 49 for the drying air; a joint 48 of the two supply lines into the same coaxial tube 46 or pair of tubes, where it crosses the side panel of the collecting pan 44.

Figure 3:
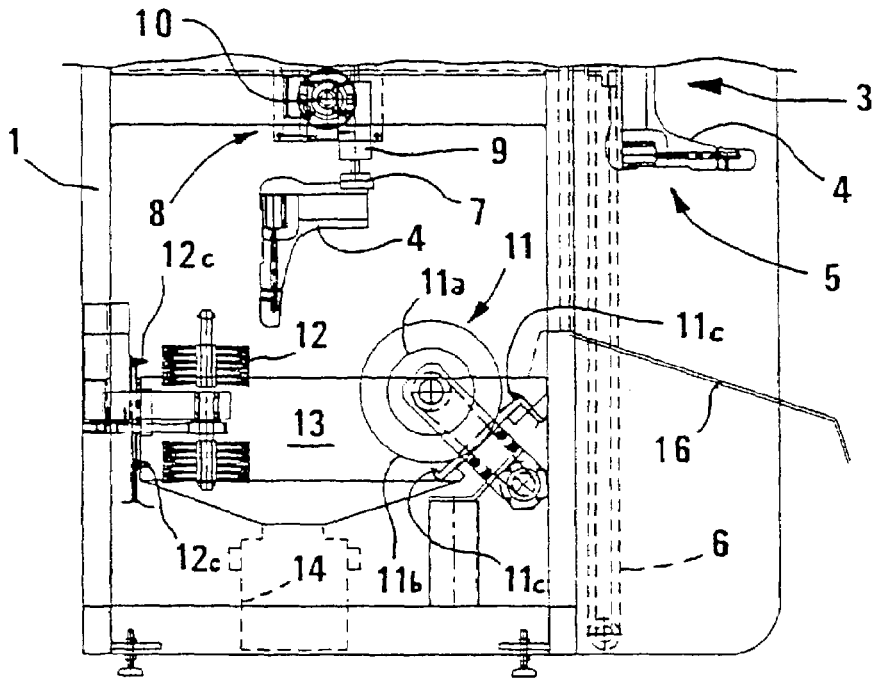
FIGS. 3 and 4 are two schematic partial longitudinal sections of the machine in the positions of cleaning the sole.
Figure 4:
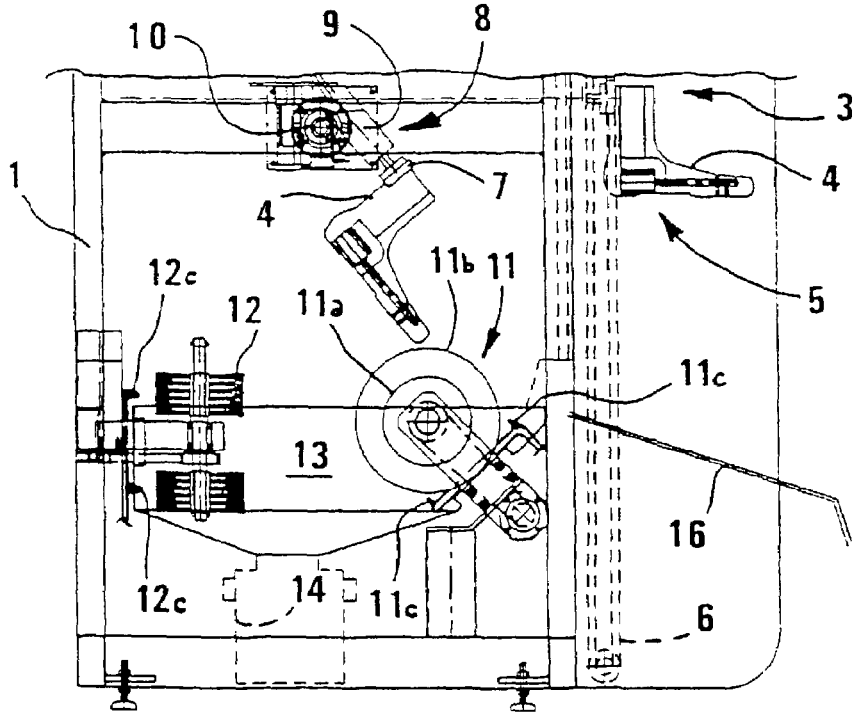
Figure 5:
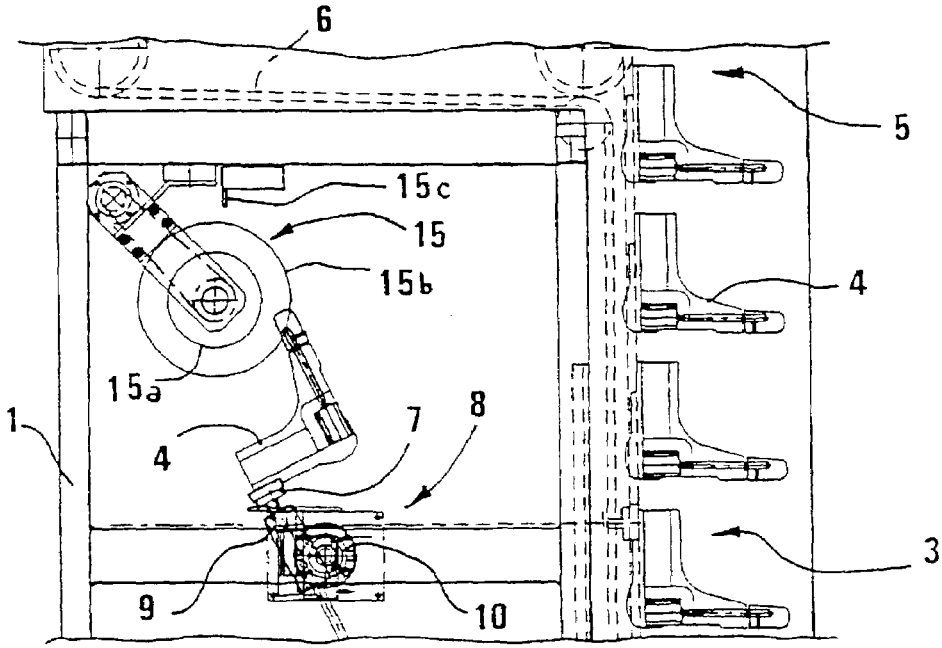
FIG. 5 is a schematic partial longitudinal section of the machine in the position of drying, oiling and polishing.
Figure 6:
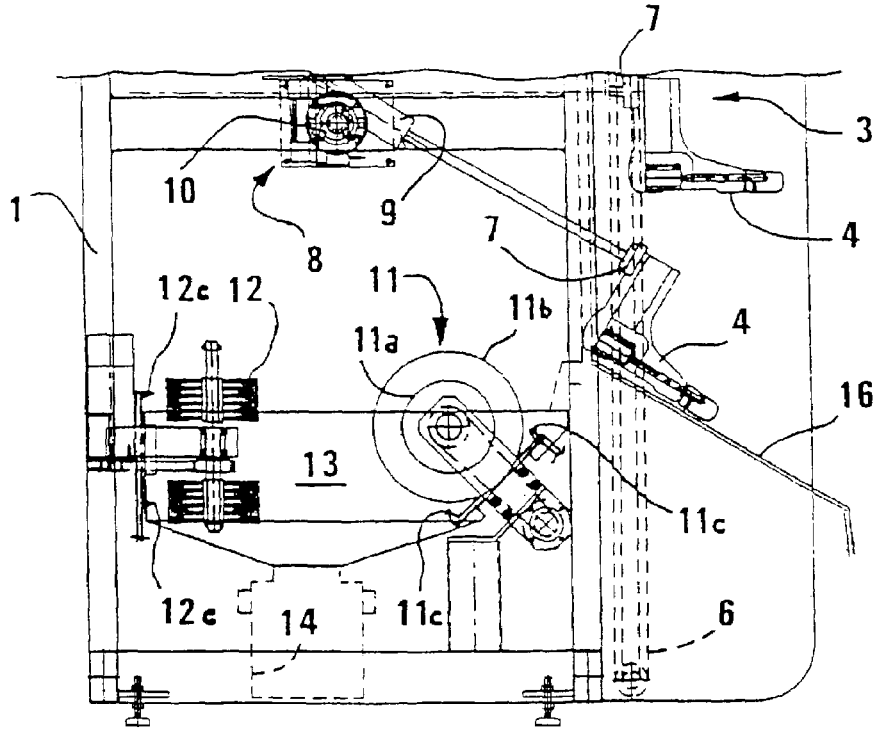
FIG. 6 is a schematic partial longitudinal section of the machine in the position of discharging the cleaned shoes.

The shoe cleaning machine operates as follows. In the case of the simpler machine, consisting of a single pair of rigid lasts not shown, the user places the shoes on the lasts 4, positioned by the machine in the loading station 3, ties each shoe securely onto respective last, ties the laces to the shoe and initiates the cleaning cycle. The operator arm 8 positions the shoes with the soles close to brushes 12 to perform the first removal of mud in a transverse direction, as shown in FIG. 3, then it repositions them by brushes 11, as shown in FIG. 4, to remove the mud with the radial bristles 11*a* in the longitudinal direction, with the suitable use of water sprayed by nozzles 11*c* and 12*c*; the combined use of the said two groups of brushes ensures perfect cleaning even of the soles with whichever arrangement of spikes. Subsequently the shoes are positioned with the upper side facing the said brushes 11, as shown in FIG. 1, so that they may be washed and cleaned. In the machines equipped with the upper drying, oiling and polishing brushes 15 the operator arm 8 rotates and positions the shoes in order to perform the said operation, as shown in FIG. 5. Finally, at the end of the cycle the machine returns the cleaned shoes to the loading station 3, where the user removes the shoes ready for use. The said operator arm 8 consists of a suitable linear actuator which has the possibility of defining intermediate positions, such as pneumatic or hydraulic jacks controlled by closed-centre valves and position sensors, alternatively rod actuators driven electrically; the said arm, furthermore, being able to rotate with respect to the frame by means of the said motor 10 controlled by an angular positioning device, such electric potential reference levels or step motor.

The dirt collected in the pan 13 can be removed by hand or, in machines equipped with shredder 14, it is conveniently reduced to a pulp so that it may be discharged into the sewer with the risk of blocking it.

In the machines 2 equipped with the storage area 5 the handling of the lasts 4, conveniently removable from the storage area and from the machine, with the shoes 19 occurs as follows: the user places the shoes on the lasts and positions them on the conveyor 6 of the storage area of the loading station 3, and either immediately or at a later time either initiates the cleaning cycle or places the shoes in a waiting position in the upper part of the storage area; a subsequent user may, immediately afterwards, position the another pair of shoes already placed on the lasts in the machine by means of the said loading station 3; in this way the storage area can be completely filled prior to starting the automatic cleaning cycle: the shoes to be cleaned are taken directly from the storage area 5 by the machine, by means of the bayonet couplings 7 of the lasts and the operator arm 8; at the end of each cleaning cycle of one pair of shoes the operator arm discharges the lasts with the shoes onto the chute 16 and picks up the next pair of shoes to be cleaned from the said loading station 3.

The lasts equipped with the manual device for securing the laces 20 are used by the user who winds the laces tightly onto the spindle 21 and then inserting the extremities 22 of the laces so that they are held by the pad 24, which, by means of protuberance 26, gives the consensus for starting the machine; in the case where the lasts may be detached from the operator arm 8, the bayonet coupling is equipped with an electrical connection for the proximity sensor 27. Also, where the lasts are equipped with driven spindles 30, the user places the extremities of the laces 20 on the spindle which, driven by motor 31, ensures the desired traction of the laces, thereby avoiding that they flap free during the action of the brushes.

The last, when it is equipped with cylinder 17 for the advancement of the extremity 18 into the shoe, enables a series of numbers of shoe sizes to be gripped, whereas the use of the fixed shape only enables the adequate gripping of a single size of shoe. The shoe and its laces have to be well gripped to avoid entry of water in the shoe.

The use of an elastic inflatable sock 28 allows the cavity of the shoe to be completely filled in an ideal manner, effectively sealing it. Furthermore, though in a limited manner, the inflatable sock when used on its own enables a secure grip on a range of shoe sizes, as in the case of the last with cylinder, but more restricted. The simultaneous use on the same last of both the said cylinder 17 and sock 28 ensures both an ample range of sizes to be griped and the effective sealing of the shoes. Advantageously, said sock presents a different changeability as the area of the shoe to which it become in contact and as the grip and/or water-proofing have to be make in that area.

In these last cases, as well as the electrical connector, the bayonet coupling 7 is also equipped with one or more compressed fluid connectors, at a pressure suitable for both the cylinder 7 and the inflatable sock 28.

Figure 13:
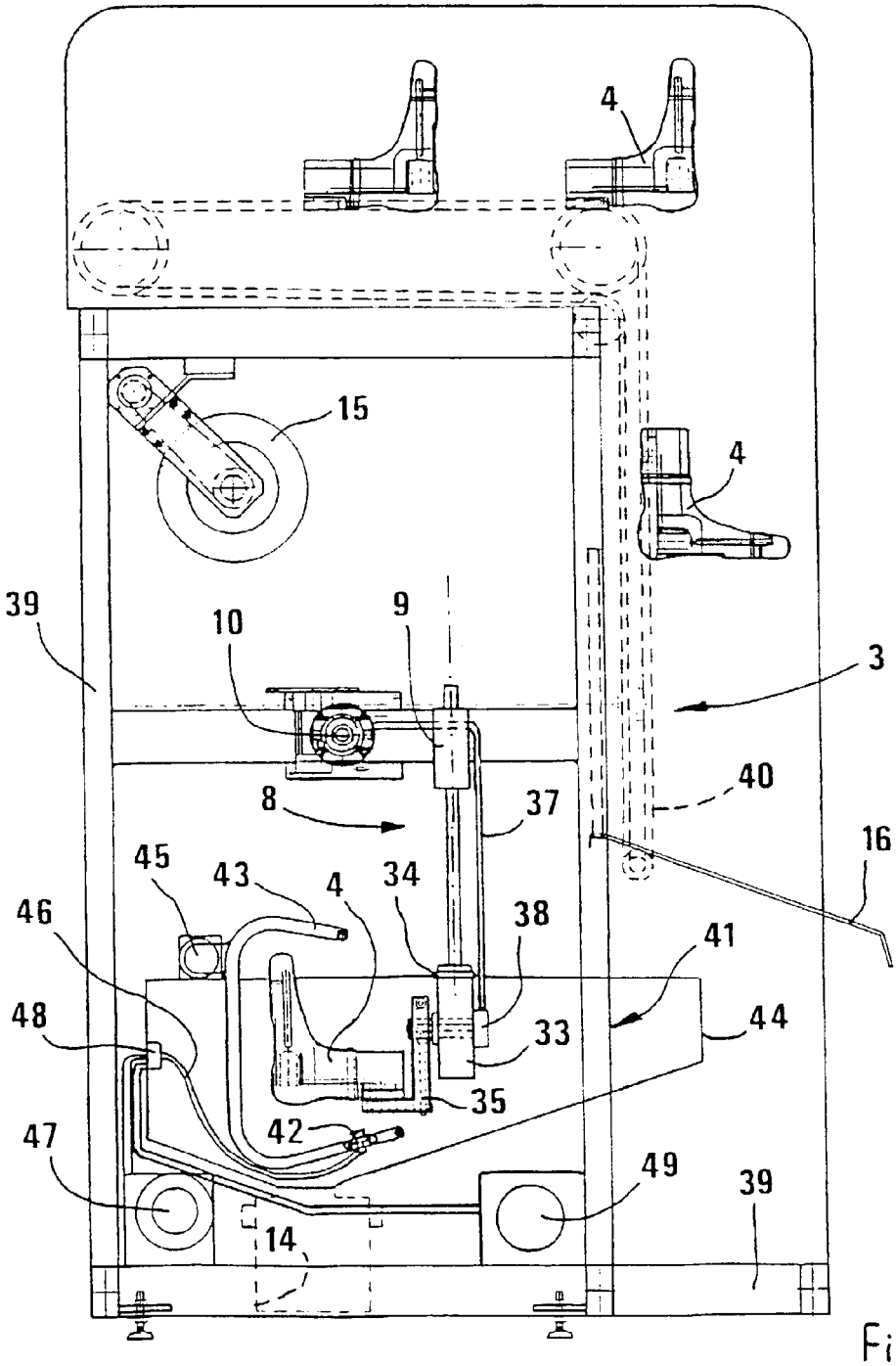
FIG. 13 is a schematic sectional view of the shoe cleaning machine in the preceding Figure with the last positioned in the station.

In the shoe cleaning machine equipped with the washing and/or drying station 41 the last 4 with the shoe is positioned on the arm 8 as shown in FIG. 13: the rotary actuator 33, whose axis of rotation is positioned in the middle of the said last 4, rotates the shoe under the action of the jets from the nozzle 42; the surface of the shoe, including the sole, is largely covered due to the mobility of the nozzles on the curved guides 43 driven by motor 45 with its reciprocating motion.

The rotation made by the said rotary actuator 33 may also be limited to less than one revolution, the positioning of the nozzle 42 along the guide 43 anyway enabling the complete coverage of the surface of the shoe.

Figure 14:
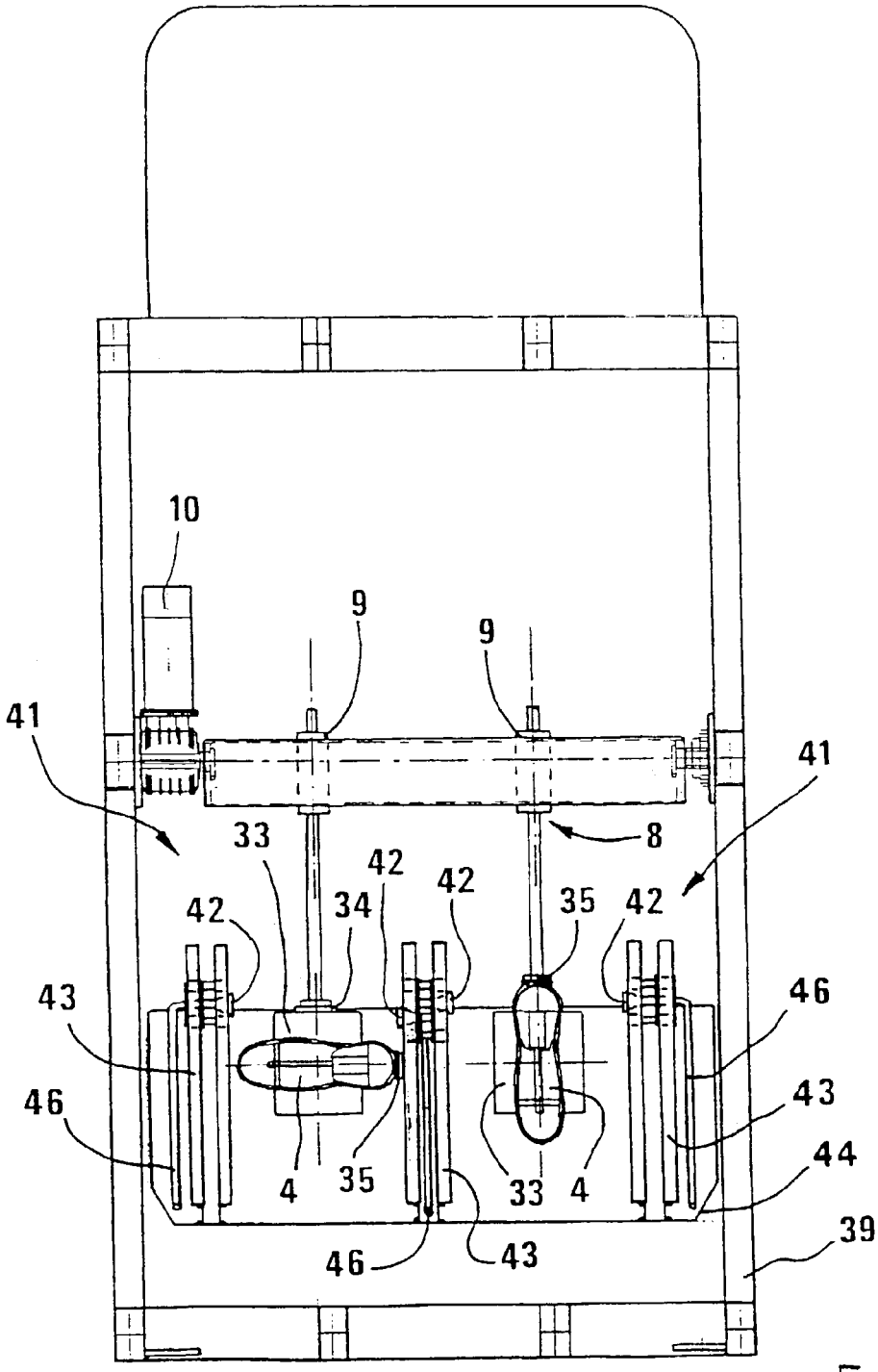
FIG. 14 is schematic sectional view in a transverse vertical plane of the machine of the preceding Figure, equipped with a pair of actuators to rotate the pair of shoes.

To obtain higher cleaning capacity the machine may be equipped with a pair of arms 8, each with its own rotary actuator 33 for each individual shoe of the pair; in the cleaning station 41 the central guides 43 between the two shoes, FIG. 14, are equipped with two nozzles, one for each shoe, and the shoes may be made independent in their rotary motion. The washing or drying action may be obtained by feeding the nozzles water or air or a mixture of the two; the expandable sock 28 ensure perfect sealing of the shoe from the water used for washing avoiding the entry of water in the shoe.

The different washing and drying operations are possible in the said station 41 by spraying water during washing and air during drying in sequence, whilst the shoe is rotated and the nozzles move along the curved guides 43; the water and air are supplied to the nozzle 42, advantageously of the combined type, to enable combined action of air and water, by means of the flexible coaxial tube 46.

In practice the materials, dimensions and details of execution may be different from, but technically equivalent to those described, without departing from the juridical domain of the present invention. The bristles for example, may be made advantageously either of synthetic or natural material. Furthermore, it is possible to provide a number of separate reservoirs for the distributor 15*c* of substances with as many nozzles, when the cycles has to include the use of different types of substance in finishing the shoe.

Furthermore, the last equipped with inflatable sock, in this case filled only with air, when removed from the arm may remain pressurised, by means of a valve, which may be deflated as and when required by the user: this is necessary when the user wishes to maintain the shape of the shoe or to soften them because they are still new. The last may advantageously be inflated using a source of compressed air which is external and separate from the cleaning machine, even though it is still equipped with a bayonet coupling for the subsequent use in the machine.

The nozzles 42 may be of the single type for spraying fluid, in which case in a station it is possible to perform either washing or drying, with the necessity of providing at least two stations to complete the cycle; alternatively, but with a more complex construction, two separate nozzles can be provided, united in their motion on the curved guides 43.

Finally, the washing and/or cleaning station with the nozzles 42 moving on guides 43 may be obtained with a single nozzle 42 directed towards the shoe, that is, radially with respect to the guide 43, and the guides themselves may be made to move laterally to be positioned to the sides or centrally in the zone of the shoe cleaning station 41.

The invention claimed is:

1. Shoe cleaning machine, comprising at least one rotatable brush means, for cleaning soles and uppers, characterized in that the said brush means includes at least one brush (11) with bristles aligned in a first direction (11*a*) and a second brush (11*b*) with bristles aligned perpendicular to those of the at least one brush; a collecting pan (13) for collecting dirt positioned under said brush means; at least one nozzle (11*c*) to spray water on the said brush means; an operator arm (8) carrying at least one last (4), to which a shoe to be cleaned is tied: said arm comprising a linear actuator (9) having more than one fixed position of extension, and a rotary actuator (10) which rotates the said arm with respect to a frame (1) of the machine, to move said lasts from a loading station (3) to the brush means and on to a discharge (16) chute.

2. Shoe cleaning machine, as claimed in claim 1, characterized in that said brush means are composed in a single rotatable brush (11) with radial bristles (11*a*) and axial bristles (11*b*) assembled and rotating simultaneously on the same brush axis.

3. Shoe cleaning machine, as claimed in claim 1, characterized in that said rotatable brush means is subdivided in two groups (11, 12) of rotatable brushes having respective axes of rotation perpendicular to each other and positioned in proximity to said collecting pan (13).

4. Shoe cleaning machine, as claimed in claim 1, characterized in that shoes are positioned on a pair of lasts (4) side by side, so conformed as to be progressively positioned simultaneously by corresponding pairs of said brush means composed in group or groups of brushes (11, 12).

5. Shoe cleaning machine, as claimed in claim 1, characterized in that beneath said collecting pan is a shredding device (14) for the discharge of mud and dirt directly to a sewer.

6. Shoe cleaning machine, as claimed in claim 1, characterized in that there are further rotatable brush means (15) for drying, oiling and polishing shoes.

7. Shoe cleaning machine, as claimed in claim 6, characterized in that the further brush means are composed of single rotatable brushes (15) with radial bristles (15*a*) and axial bristles (15*b*) assembled and rotating simultaneously on the same brush axis.

8. Shoe cleaning machine, as claimed in claim 1, characterized in that there is a storage area (5) associated with the shoe cleaning machine, the storage area having a conveyor (6) on which a number of shoes are placed, already tied on their respective lasts (4) feed of the shoes into the storage area being handled directly by the cleaning machine (2); each last or pair of lasts (4) having at least one bayonet coupling (7) to attach the last or the pair of lasts to the operator arm (8).

9. Shoe cleaning machine, as claimed in claim 8, characterized in that said bayonet coupling (7) has an electrical connection or one or more connectors for pressurised fluids.

10. Shoe cleaning machine, as claimed in claim 1, characterized in that each last (4) has a manual device for winding shoe laces, consisting of a pin or spindle (21) onto which the laces (20) are wound and of a detecting device (23) for detecting the extremities (22) of the laces.

11. Shoe cleaning machine, as claimed claim 10, characterized in that said manual device (23, 24, 25, 26) has an electrical sensor (27) for detecting whether the extremities (22) of the laces are fixed.

12. Shoe cleaning machine, as claimed in claim 1, characterized in that each last has a driven spindle (30) for winding laces (20) of the related tied shoe (19).

13. Shoe cleaning machine, as claimed in claim 12, characterized in that said spindle (30) is driven by an electric motor (31) with output torque control.

14. Shoe cleaning machine, comprising at least a washing and drying station (41), for washing soles and uppers, characterized in that the said station (41) consists of at least one water or air spraying nozzle (42) moving on guides (43) and made to spray the external surface of the shoe: a pan (44) to collect dirt positioned under the washing or drying station; at least one operator arm (8) carrying at least one last (4), to which one shoe to be cleaned is tied: said arm comprising a linear actuator (9) having fixed positions of extension and a rotary actuator (10) to rotate said arm with respect to a frame (39) of the machine, to move said lasts from a loading station (3) to the washing station (41) and to a discharge chute (16); and, a further rotary actuator (33) associated with said operator arm to rotate said last with respect to the arm.

15. Shoe cleaning machine, as claimed in claim 14, whererin the nozzles (43) are mobile nozzles and characterised in that said guides (43) have a curved configuration.

16. Shoe cleaning machine, as claimed in claim 14, characterized in that the mobile nozzles (42) are of the combined type suitable for spraying both water or air, or both simultaneously, so as to provide a single washing and cleaning station (41).

17. Shoe cleaning machine, as claimed in claim 14, characterized in that said last (4) is carried on said further rotary actuator (33) with an angular rotating support (35) to settle the middle of the shoe on its axis of rotation.

18. Shoe cleaning machine, as claimed in claim 14, characterized in that said guides (43) move laterally in the zone where the shoes are positioned in the washing and drying station (41).

19. Shoe cleaning machine, as claimed in claim 14, characterized in that the said guides (43) are central to the washing station (41) with two shoes being washed, on which two nozzles (42) are positioned, each pointing to a zone where a shoe to be cleaned is positioned.

20. Shoe cleaning machine, as claimed in claim 1, characterized in that each last (4) has an actuator cylinder (17) to advance an extremity (18) of said last.

21. Shoe cleaning machine, as claimed in claim 1, characterized in that each last is covered by an inflatable elastic sock (28), shaped to grip the shoe (19) inside to prevent the entry of water.

22. Shoe cleaning machine, as claimed in claim 20, characterized in that each last is covered by an inflatable elastic sock (28), fitting over the extremity (18) and the actuator cylinder (17), the elastic sock (28) being shaped to grip the inside the shoe to prevent the entry of water.

23. Shoe cleaning machine of claim 20 wherein the last (4) for positioning of the shoes in the shoe cleaning machine (2) has a bayonet coupling (7), characterized in that the bayonet coupling has a valve for retaining pressurized fluid to maintain pressure after use in the shoe cleaning machine, even when the last is detached from the cleaning machine.

24. Shoe cleaning machine of claim 23 wherein said valve is able to be supplied by a compressed air source external to the cleaning machine.

* * * * *